US009735554B2

(12) United States Patent
Fujii

(10) Patent No.: US 9,735,554 B2
(45) Date of Patent: Aug. 15, 2017

(54) METHOD FOR MANUFACTURING SPARK PLUG

(71) Applicant: NGK Spark Plug Co., LTD., Nagoya (JP)

(72) Inventor: Keisuke Fujii, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/309,694

(22) PCT Filed: Jun. 11, 2015

(86) PCT No.: PCT/JP2015/002940

§ 371 (c)(1),
(2) Date: Nov. 8, 2016

(87) PCT Pub. No.: WO2015/198550

PCT Pub. Date: Dec. 30, 2015

(65) Prior Publication Data

US 2017/0141546 A1 May 18, 2017

(30) Foreign Application Priority Data

Jun. 26, 2014 (JP) ..... 2014-131378

(51) Int. Cl.
*H01T 21/02* (2006.01)
*H01T 13/20* (2006.01)

(52) U.S. Cl.
CPC ..... *H01T 21/02* (2013.01); *H01T 13/20* (2013.01)

(58) Field of Classification Search
CPC ..... H01T 21/02; H01T 13/20
See application file for complete search history.

(56) References Cited

U.S. PATENT DOCUMENTS

2001/0015602 A1* 8/2001 Hori ..... H01T 21/06 313/141
2004/0129683 A1 7/2004 Torii et al.
2013/0280980 A1 10/2013 Tanaka et al.

FOREIGN PATENT DOCUMENTS

| | | | |
|---|---|---|---|
| JP | 2004-158220 | A | 6/2004 |
| JP | 2007-80638 | A | 3/2007 |
| JP | 2007-80639 | A | 3/2007 |
| JP | 2009-187721 | A | 8/2009 |
| JP | 2013-191549 | A | 9/2013 |
| JP | 2013-206789 | A | 10/2013 |
| WO | WO-2012/098905 | A | 7/2012 |

OTHER PUBLICATIONS

International Search Report mailed Sep. 1, 2015 for the corresponding PCT Application No. PCT/JP2015/002940.

* cited by examiner

*Primary Examiner* — Donald Raleigh
*Assistant Examiner* — Kevin Quarterman
(74) *Attorney, Agent, or Firm* — Leason Ellis LLP

(57) ABSTRACT

A method for manufacturing a spark plug includes: a joining step of joining a rod-shaped ground electrode member to a front end portion of a metal shell; a tilt step of tilting the ground electrode member in a radial direction of the metal shell; a correction step of decreasing a tilt angle of the ground electrode member to an allowable tilt angle or less; and a welding step of welding a ground electrode tip to the ground electrode member.

8 Claims, 5 Drawing Sheets

| WITH/WITHOUT CORRECTION PROCESSING | WELDING RESULTS OF SAMPLES (NOS. 1 TO 10) | | | | | | | | | |
|---|---|---|---|---|---|---|---|---|---|---|
| | 1 | 2 | 3 | 4 | 5 | 6 | 7 | 8 | 9 | 10 |
| WITHOUT CORRECTION PROCESSING | ○ | ○ | × | ○ | × | × | × | × | ○ | × |
| WITH CORRECTION PROCESSING | ○ | ○ | ○ | ○ | ○ | ○ | ○ | ○ | ○ | ○ |

○ : THERE WAS NO WELDING SPATTER TRACE ON BACK SURFACE OF GROUND ELECTRODE

× : THERE WAS WELDING SPATTER TRACE ON BACK SURFACE OF GROUND ELECTRODE

FIG. 3

METHOD FOR MANUFACTURING SPARK PLUG

CROSS-REFERENCE TO RELATED PATENT APPLICATIONS

This application is a U.S. National Phase Application under 35 U.S.C. §371 of International Patent Application No. PCT/JP2015/002940, filed Jun. 11, 2015, and claims the benefit of Japanese Patent Application No. 2014-131378, filed on Jun. 26, 2014, all of which are incorporated herein by reference in their entirety. The International Application was published in Japanese on Dec. 30, 2015 as International Publication No. WO/2015/198550 under PCT Article 21(2).

FIELD OF THE INVENTION

The present invention relates to a method for manufacturing a spark plug.

BACKGROUND OF THE INVENTION

In general, a spark plug includes a center electrode and a ground electrode at a front side thereof. The center electrode projects from a front end of an insulator in a state where the center electrode is held in an axial hole of the insulator. Meanwhile, the ground electrode is joined to a front end portion of a metal shell.

As one type of spark plug, a spark plug is present in which a ground electrode tip is joined to a ground electrode. In a general method, in joining the ground electrode tip to the ground electrode, first, a ground electrode member is welded to a metal shell, and then resistance welding (or resistance welding and laser welding) is performed to weld the ground electrode tip to the ground electrode member (See Japanese Patent Application Laid-Open (kokai) No. 2013-206789).

Problem to be Solved by the Invention

However, in a step of welding the ground electrode tip to the ground electrode member, tilt of the ground electrode member with respect to the metal shell may not be uniform due to influence of a step previous to this step. Thus, the welding conditions are not stable, and insufficient weld penetration of the ground electrode tip to the ground electrode member occurs. Accordingly, there is a problem that the welding strength of the ground electrode tip may become insufficient.

SUMMARY OF THE INVENTION

Means for Solving the Problem

The present invention has been made to solve the above-described problem, and can be embodied in the following modes.

(1) According to an aspect of the present invention, a method for manufacturing a spark plug including a metal shell and a ground electrode having a ground electrode tip is provided. The method includes: a joining step of joining a rod-shaped ground electrode member to a front end portion of the metal shell, next; a tilt step of tilting the ground electrode member in a radial direction of the metal shell, next; a correction step of decreasing a tilt angle of the ground electrode member to an allowable tilt angle or less, next; and a welding step of welding the ground electrode tip to the ground electrode member. According to this method, since the tilt angle of the ground electrode member is decreased to the allowable tilt angle or less after the ground electrode member is forcedly tilted once, it becomes possible to perform wielding under stable welding conditions, so that a possibility that the welding strength of the ground electrode tip decreases can be reduced.

(2) The above method may further include, between the tilt step and the correction step, a jig placing step of placing a first jig and a second jig as correction processing jigs along a first direction parallel to the radial direction of the metal shell and at positions away from the ground electrode member so as to provide a positional relation in which the ground electrode member is sandwiched therebetween, the first jig being placed at one side in the first direction, the second jig being placed at another side in the first direction; and in the correction step, the tilt angle of the ground electrode member may be decreased by moving the first jig in a second direction opposite to the first direction to press the ground electrode member until a state where the ground electrode member comes into direct or indirect contact with the second jig. According to this method, correction of causing the tilt angle of the ground electrode member to be the allowable tilt angle or less can be easily performed.

(3) In the above manufacturing method, in the tilt step, the ground electrode member may be tilted outward in the radial direction of the metal shell. According to this method, in the correction step after the tilt step, correction can be performed without pressing a tip welding surface of the ground electrode member. Thus, a possibility that scratches are made on the tip welding surface can be reduced.

(4) In the above manufacturing method, the first jig and the second jig may be used as welding electrodes for resistance welding in the welding step, and, in the correction step, the second jig may be used in a state where the ground electrode tip is placed on an end of the second jig. According to this method, since the first jig and the second jig, which are used as welding electrodes, are also used as correction processing jigs, the number of the jig can be reduced, and jig switching is unnecessary to switch the jigs, so that the manufacturing process can be simplified.

(5) In the above manufacturing method, the allowable tilt angle in the correction step may be such an angle that, in the welding step, a state is obtained in which the ground electrode member and the first jig are in surface contact with each other and the ground electrode member and the ground electrode tip are in surface contact with each other. According to this method, in the welding step, the welding electrode and the ground electrode member are in surface contact with each other, and the ground electrode member and the ground electrode tip are in surface contact with each other, so that the welding conditions become further stable.

(6) In the above manufacturing method, a position at which a tilt processing jig contacts the ground electrode member in the tilt step may be different from a position at which a correction processing jig contacts the ground electrode member in the correction step. If the tilt processing jig and the correction processing jig contact the ground electrode member at the same position, there is a possibility of occurrence of a problem that the tip welding surface deforms and/or a problem that the tilt angle cannot be decreased successfully in the correction step. According to the above method, the tilt processing and the correction processing are performed at different positions on the ground electrode member, so that such problems can be avoided.

(7) In the above manufacturing method, the correction processing jig may be a jig different from the tilt processing jig. If the tilt step and the correction step are performed with the same jig, there is a possibility of occurrence of a problem that the tip welding surface deforms and/or a problem that the tilt angle cannot be decreased successfully in the correction step. According to the above method, the tilt step and the correction step are executed with different jigs, so that such problems can be avoided.

(8) In the above manufacturing method, in the tilt step, the ground electrode member may be tilted such that a bent portion is not formed at a welding position, for the ground electrode tip, on the ground electrode member, and is formed at a front side with respect to the welding position. In the tilt step, a bent portion is easily formed. However, according to the above method, since the ground electrode member is tilted such that a bent portion is not formed at the tip welding position, tip welding can be performed under stable welding conditions.

(9) The above manufacturing method may further include, before the tilt step, a step of assembling an insulator and a center electrode to the metal shell. When the insulator and the center electrode are assembled to the metal shell before welding the ground electrode tip, the tip can be welded after manufacturing variations from the metal shell to the center electrode are grasped. Thus, dimensional variations of the spark gap of the spark plug can be reduced. Meanwhile, there is a possibility that the presence of the insulator and the center electrode hinders the correction step, etc. However, with the above method, it is possible to weld the tip with a stable shape even when the insulator and the center electrode are present, and the invention of the present application can achieve the advantageous effects particularly in such a situation.

The present invention can be embodied in various forms. For example, the present invention can be embodied in forms such as a method for manufacturing a spark plug and a method for manufacturing a metal shell for a spark plug.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 3 is an explanatory diagram showing welding results of samples.

DETAILED DESCRIPTION OF THE INVENTION

A. First Embodiment

Figure 1:
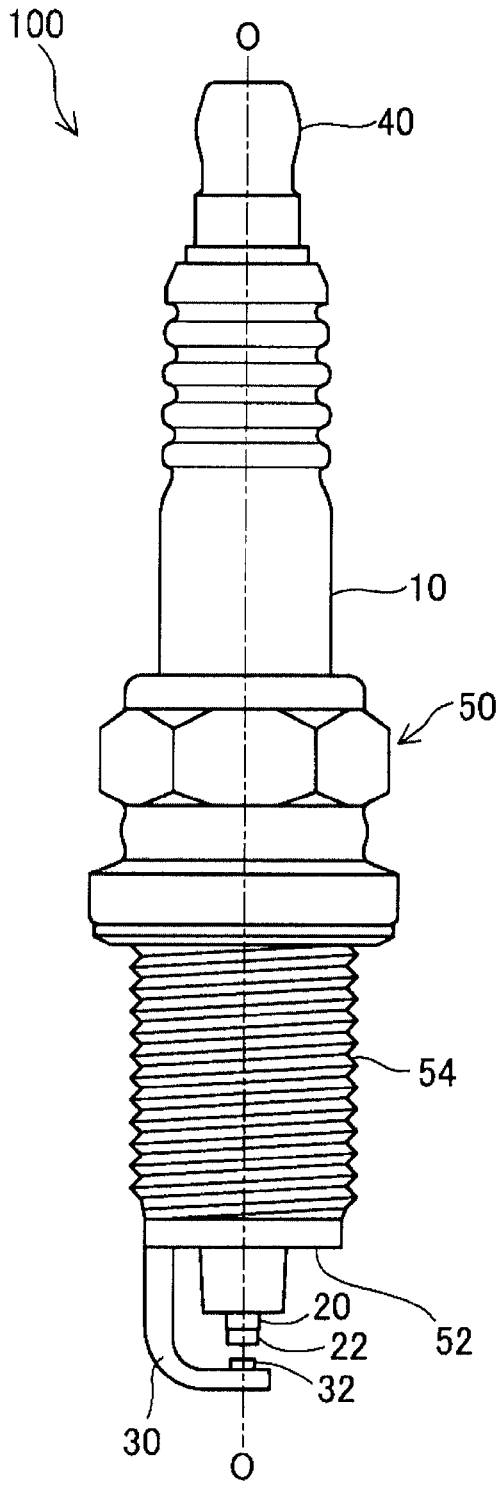
FIG. 1 is a front view showing a spark plug according to an embodiment.

FIG. 1 is a front view showing a spark plug 100 according to an embodiment of the present invention. In FIG. 1, the lower side at which a firing end of the spark plug 100 is present is defined as a front side of the spark plug 100, and the upper side is defined as a rear side of the spark plug 100. The spark plug 100 includes an insulator 10, a center electrode 20, a ground electrode 30, a metal terminal 40, and a metal shell 50. The insulator 10 has an axial hole extending along an axial line O. The axial line O is also referred to as "central axis". The center electrode 20 is a rod-shaped electrode extending along the axial line O, and is held in a state where the center electrode 20 is inserted into the axial hole of the insulator 10. The ground electrode 30 is an electrode that is fixed at one end thereof to a front end portion 52 of the metal shell 50 and is opposed at another end thereof to the center electrode 20. The metal terminal 40 is a terminal for receiving supply of power and is electrically connected to the center electrode 20. A center electrode tip 22 is welded to the front end of the center electrode 20, and a ground electrode tip 32 is welded to the inner surface of the ground electrode 30. Each of the tips 22 and 32 is preferably a noble metal tip formed from a noble metal such as Pt (platinum) or Ir (iridium), but a metal that is not a noble metal may be used. For convenience of illustration, the tips 22 and 32 are depicted in a size larger than the actual size. The metal shell 50 is a tubular member that covers the periphery of the insulator 10, and fixes the insulator 10 therein. A screw portion 54 is formed on the outer periphery of the metal shell 50. The screw portion 54 is a portion in which a thread is formed, and is screwed into a screw hole of an engine head in mounting the spark plug 100 to the engine head.

Figure 2:
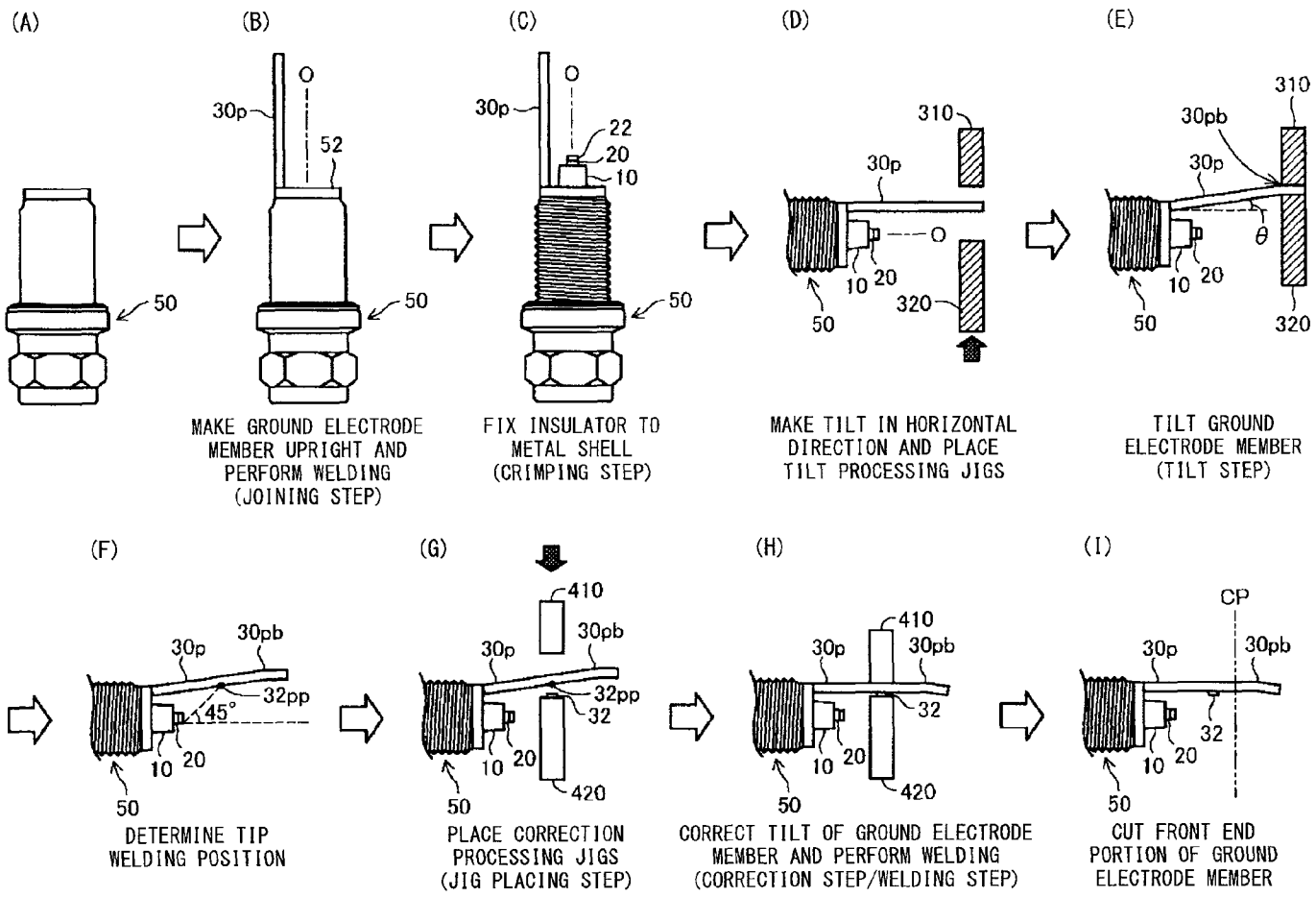
FIGS. 2(A) to 2(I) are explanatory diagrams each showing a part of a process for manufacturing the spark plug according to the first embodiment.

FIGS. 2(A) to 2(I) show a part of a process for manufacturing the spark plug according to the first embodiment. FIG. 2(A) shows a step of preparing the metal shell 50 before joining the ground electrode 30. FIG. 2(B) shows a joining step of joining a linearly extending rod-shaped ground electrode member 30*p* to the front end portion 52 of the metal shell 50 in a state where the ground electrode member 30*p* is substantially upright. Here, "upright" means a state of being directed in a direction parallel to the axial line O of the metal shell 50. However, in the joining step, it is not necessary to make the ground electrode member 30*p* upright, and the ground electrode member 30*p* may be joined in a tilted state. In the joining step, for example, resistance welding is used. In the steps in FIGS. 2(A) and 2(B), the screw portion 54 (FIG. 1) has not been formed in the metal shell 50, and a plating process has not been performed on the metal shell 50 and the ground electrode member 30*p*. In this case, after the step in FIG. 2(B), preferably, the screw portion 54 is formed in the metal shell 50 by rolling, an extra raised portion of a melt portion of a welded portion between the ground electrode member 30*p* and the metal shell 50 is removed, and further a plating process is performed. FIG. 2(C) shows a crimping step (also referred to as "assembling step") of inserting the insulator 10 to which the center electrode 20 has been assembled, into the metal shell 50, and crimping a to-be-crimped portion (not shown) at the rear end of the metal shell 50, to fix the insulator 10. In the present embodiment, a front end portion of the insulator 10 projects from the front end portion 52 of the metal shell 50, and a front end portion of the center electrode 20 and the center electrode tip 22 project from the front end portion of the insulator 10. In another embodiment, the front end portion of the insulator 10 may not project from the front end portion 52 of the metal shell 50, and the front end portion of the center electrode 20 and the center electrode tip 22 may project from the front end portion of the insulator 10. In still another embodiment, the front end portion of the center electrode 20 may not project from the front end portion of the insulator 10, and at least a part of the center electrode tip 22 may project from the front end portion of the insulator 10. In addition, all of the insulator 10, the center electrode 20, and the center electrode tip 22 may not project from the front end portion 52 of the metal shell 50.

FIG. 2(D) and the subsequent drawings show various steps performed for welding the ground electrode tip 32 to the ground electrode member 30*p*. In the above-described step in FIG. 2(B), there is a possibility that the ground electrode member 30*p* is not joined in a properly upright state. In addition, between the step in FIG. 2(B) and the step in FIG. 2(C) or between the step in FIG. 2(C) and the step in FIG. 2(D), another step other than these steps (e.g., a plating step) may be performed, and there is a possibility that the ground electrode member 30*p* is slightly tilted from an upright state in the other step. If tilt of the ground electrode member 30*p* is varied as described above in welding the ground electrode tip 32, the welding conditions are not stable, and insufficient weld penetration of the ground electrode tip 32 to the ground electrode member 30*p* occurs. Accordingly, there is a possibility that the welding strength of the ground electrode tip 32 becomes insufficient. For that reason, in steps in FIG. 2(D) and the subsequent drawings, the ground electrode member 30*p* is forcedly tilted and then corrected to a substantially uniform attitude, and then welding is executed.

FIG. 2(D) shows a step of rotating the metal shell 50 by approximately 90 degrees clockwise, holding the metal shell 50 in an attitude in which the axial line O of the metal shell 50 extends in a horizontal direction, and then placing a first jig 310 and a second jig 320 as tilt processing jigs above and below the ground electrode member 30*p*, respectively, in a state where the first jig 310 and the second jig 320 are opposed to each other. In this example, the first jig 310 is placed at a position vertically above and away from a front end portion of the ground electrode member 30*p*, and the second jig 320 is placed at a position vertically below and away from the front end portion of the ground electrode member 30*p*. At this time, the height of the first jig 310 is preferably set to a height away from the height of the axial line O of the metal shell 50 (or the center electrode 20) by a predetermined distance. FIG. 2(E) shows tilt processing of pressing the second jig 320 upward from the state in FIG. 2(D), and holding the front end portion of the ground electrode member 30*p* in a state where the front end portion of the ground electrode member 30*p* is sandwiched between the first jig 310 and the second jig 320. By the tilt step, it is possible to tilt the ground electrode member 30*p* outward in a radial direction by a fixed angle θ from a direction parallel to the axial line O of the metal shell 50. Here, the "radial direction" means a direction perpendicular to the axial line O. The angle θ is set to an angle greater than an allowable tilt angle in a correction step described later. A bent portion 30*pb* is formed in the front end portion of the ground electrode member 30*p* and at a position sandwiched between the first jig 310 and the second jig 320 for tilt processing. Preferably, the bent portion 30*pb* is not formed at a position where the ground electrode tip 32 is welded (referred to as "tip welding position"), and is located at the front side with respect to the tip welding position. The reason is that, when the bent portion 30*pb* formed in the tilt step is formed at the tip welding position, there is a possibility that the welding conditions for the ground electrode tip 32 are not stable. In other words, by tilting the ground electrode member 30*p* such that the bent portion 30*pb* is not formed at the tip welding position, it is made possible to weld the ground electrode tip 32 under stable welding conditions.

In FIG. 2(F), a tip welding position 32*pp* at which the ground electrode tip 32 is to be welded is determined on the inner surface (the lower surface in the drawing) of the ground electrode member 30*p*. In this step, for example, by capturing the attitudes of the center electrode 20 and the ground electrode member 30*p* with a camera and analyzing an image thereof, it is possible to determine the tip welding position 32*pp*. In the example of FIG. 2(F), a position of intersection between the inner surface (lower surface) of the ground electrode member 30*p* and a straight line that extends from the lower end of the center electrode 20 as a starting point in an upward direction tilted at 45 degrees, is determined as the tip welding position 32*pp*. However, various methods other than this method can be adopted as the method for determining the tip welding position 32*pp*.

FIG. 2(G) shows a jig placing step of placing a first jig 410 and a second jig 420 as correction processing jigs above and below the ground electrode member 30*p*, respectively, in a state where the first jig 410 and the second jig 420 are opposed to each other. In this example, the first jig 410 is placed at a position vertically above and away from the tip welding position 32*pp*, and the second jig 420 is placed at a position vertically below and away from the tip welding position 32*pp*. In the present embodiment, the first jig 410 and the second jig 420 for correction processing are also used as welding electrodes in a welding step described later. Thus, the ground electrode tip 32 is held in a recess portion (not shown) at the upper surface of the second jig 420 in a state where the ground electrode tip 32 projects therefrom. The ground electrode tip 32 is held, for example, by sucking a suction hole provided in the recess portion at the upper surface of the second jig 420, using a vacuum pump that is not shown. However, the recess portion may not be present at the upper surface of the second jig 420. The position (height) of the first jig 410 is preferably set at a position away from the height of the axial line O of the metal shell 50 (or the upper surface of the metal shell 50 in the state of FIG. 2(D)) by a predetermined distance.

FIG. 2(H) shows the correction step of pressing the first jig 410 downward from the state of FIG. 2(G), and holding the ground electrode member 30*p* in a state where the ground electrode member 30*p* is sandwiched between the first jig 410 and the second jig 420. By the correction step, it is possible to decrease the tilt of the ground electrode member 30*p* to decrease the tilt angle of the ground electrode member 30*p* to the predetermined allowable tilt angle or less. The allowable tilt angle can be determined experimentally as an angle sufficient to stabilize the welding conditions. For example, the allowable tilt angle may be ±3° from the upright direction (a direction parallel to the axial line O). In the correction step, a protective material (protective sheet, etc.) may be provided on the ground electrode tip 32 in order to protect the surface of the ground electrode tip 32. In this case, in the correction step, the first jig 410 is moved until the ground electrode member 30*p* comes into indirect contact with the second jig 420. On the other hand, in the correction step, in the case where a protective material (protective sheet, etc.) is not provided on the ground electrode tip 32, the first jig 410 is moved until the ground electrode member 30*p* comes into direct contact with the second jig 420.

The positions at which the tilt processing jigs 310 and 320 come into contact with the ground electrode member 30*p* in the above-described tilt step in FIG. 2(E) are preferably different from the positions at which the correction processing jigs 410 and 420 come into contact with the ground electrode member 30*p* in the correction step in FIG. 2(H). If the tilt processing jigs 310 and 320 and the correction processing jigs 410 and 420 come into contact with the ground electrode member 30*p* at the same positions, there is a possibility of occurrence of a problem that a tip welding surface deforms or a problem that the tilt angle cannot be decreased successfully in the correction step. On the other hand, when the positions at which the tilt processing jigs 310 and 320 come into contact are made different from the positions at which the correction processing jigs 410 and 420 come into contact, the tilt processing and the correction processing are performed at different positions on the ground electrode member 30*p*, so that it is possible to avoid such problems.

In FIG. 2(H), further, after the above-described correction step, the welding step of welding the ground electrode tip 32 to the ground electrode member 30*p* is performed by performing resistance welding using the first jig 410 and the second jig 420 as welding electrodes. In a state after the correction step and before the welding step, preferably, the ground electrode tip 32 and the ground electrode member 30*p* are in surface contact with each other, and the ground electrode member 30*p* and the first jig 410 (welding electrode) are also in surface contact with each other. With this configuration, a state is obtained in which the upper surface and the lower surface of the ground electrode member 30*p* are in surface contact, so that there is an advantage that the welding conditions become further stable. As the correction processing jigs 410 and 420, members different from welding electrodes may be used. However, when the same members are used as both, the number of the jigs can be reduced, and jig switching is unnecessary, so that the manufacturing process can be simplified.

FIG. 2(I) shows a cutting step of cutting the front end portion of the ground electrode member 30*p*. A cutting position CP is preferably set between the ground electrode tip 32 and the bent portion 30*pb*. However, the cutting step may be omitted. Thereafter, a bending step (not shown) for bending the ground electrode member 30*p* into a final bent shape (FIG. 1) is performed. In the bending step, the rod-shaped ground electrode member 30*p* may be bent in a single step, or may be bent separately in two steps, that is, a provisional bending step and a regular bending step.

When the ground electrode tip 32 is joined to the ground electrode member 30*p* according to the steps described with reference to FIGS. 2(A) to 2(I), since the tilt angle of the ground electrode member 30*p* is decreased to the allowable tilt angle or less after the ground electrode member 30*p* is forcedly tilted once, it becomes possible to weld the ground electrode tip 32 under stable welding conditions, so that a possibility that the welding strength of the ground electrode tip 32 decreases can be reduced.

FIG. 3 is an explanatory diagram showing welding results in the case where the correction processing shown in FIGS. 2(D) to 2(H) was performed and in the case where the correction processing was not performed. Here, for each of the case without the correction processing and the case with the correction processing, welding results of 10 samples are shown. The mark "O" indicates that there was no welding spatter trace on the back surface of the ground electrode member 30*p* after resistance welding, and the mark "X" indicates that there was welding spatter trace on the back surface of the ground electrode member 30*p* after resistance welding. Here, the "welding spatter trace" means trace that is formed on the ground electrode member 30*p* due to occurrence of some sort of welding failure during resistance welding and can be seen as if spatter occurred. The welding spatter trace indicates that welding is not properly performed, and the welding strength is generally low when there is welding spatter trace. As shown in FIG. 3, in the case where the correction processing was performed on the ground electrode member 30*p*, no welding spatter trace occurred. On the other hand, in the case where the correction processing was not performed, welding spatter trace occurs in many proportions. Also from the results, it can be understood that by performing the correction processing shown in FIGS. 2(D) to 2(H), it is made possible to weld the ground electrode tip 32 under stable welding conditions, so that a decrease in the welding strength of the ground electrode tip 32 can be inhibited.

B. Second Embodiment

Figure 4:
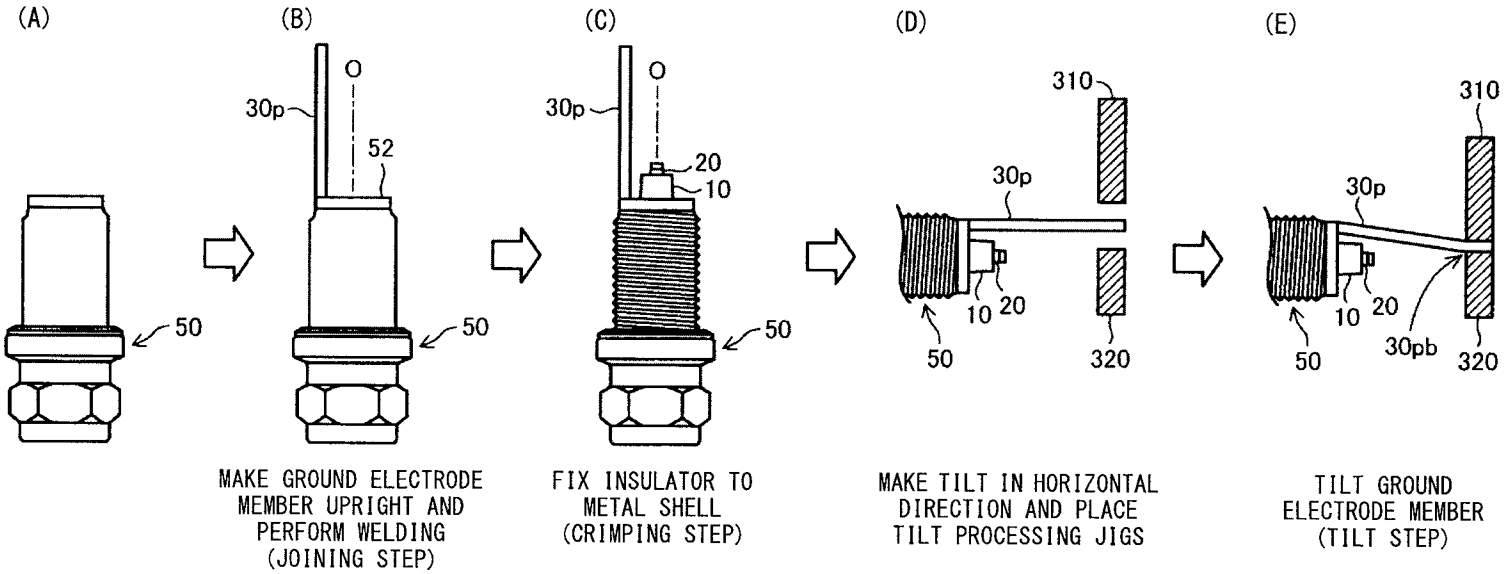
FIGS. 4(A) to 4(E) are explanatory diagrams each showing a part of a process for manufacturing a spark plug according to a second embodiment.
Figure 5:
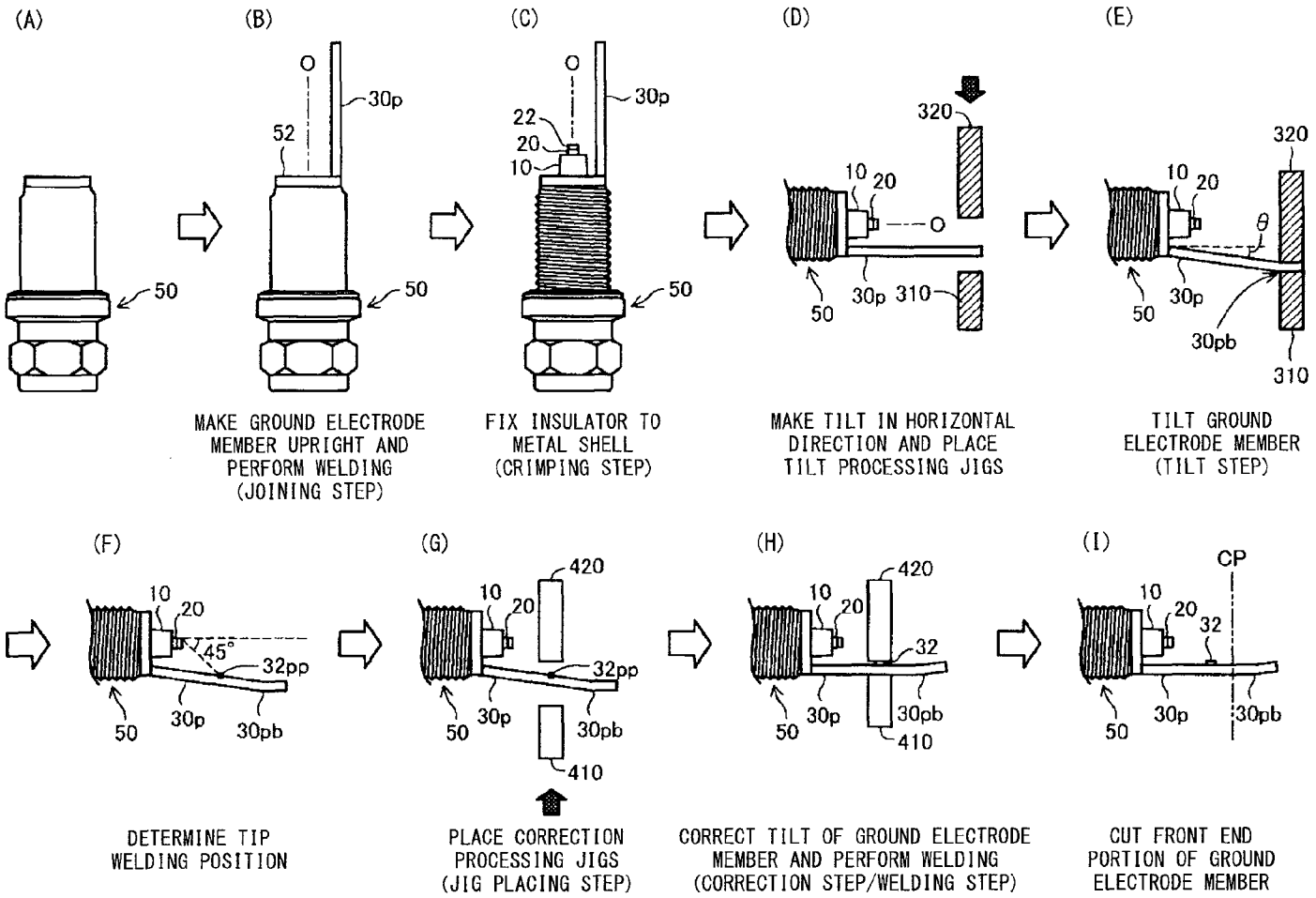
FIGS. 5(A) to 5(I) are explanatory diagrams each showing a part of a process for manufacturing a spark plug according to a third embodiment.

FIGS. 4(A) to 4(E) show a part of a process for manufacturing a spark plug according to a second embodiment and show steps corresponding to FIGS. 2(A) to 2(E). FIGS. 4(A) to 4(C) are the same as FIGS. 2(A) to 2(C). The second embodiment is different from the first embodiment mainly in that, in FIG. 4(E), the ground electrode member 30*p* is tilted inward in the radial direction. That is, in a tilt step performed in FIGS. 4(D) and 4(E), the first jig 310 as a tilt processing jig is pressed downward, and the front end portion of the ground electrode member 30*p* is held in a state where the front end portion of the ground electrode member 30*p* is sandwiched between the first jig 310 and the second jig 320. Steps after the step in FIG. 4(E) are substantially the same as the steps after the step in FIG. 2(E) except for the manner in which the ground electrode member 30*p* is tilted, and thus the description thereof is omitted.

As can be understood from FIGS. 2(E) and 4(E), the ground electrode member 30*p* may be tilted outward in the radial direction, or may be tilted inward in the radial direction. However, when the ground electrode member 30*p* is tilted outward in the radial direction as in the example of FIG. 2(E), correction can be performed in the later correction step (FIG. 2(H)) without pressing the tip welding surface of the ground electrode member 30*p*. Thus, there is an advantage that a possibility that scratches are made on the tip welding surface can be reduced.

C. Third Embodiment

FIGS. 5(A) to 5(I) show a part of a process for manufacturing a spark plug according to a third embodiment and show steps corresponding to FIGS. 2(A) to 2(I). The third embodiment is different from the first embodiment mainly in that, in FIGS. 5(D) to 5(I), the ground electrode member 30*p* is placed vertically below the center electrode 20. In addition, the third embodiment is also different from FIG. 2 in that, in a jig placing step in FIG. 5(G) and a correction step in FIG. 5(H), the ground electrode tip 32 is not placed at the end of the second jig 420 for correction processing, and the ground electrode tip 32 is placed on the tip welding surface (the upper surface in FIG. 5(H)) of the ground electrode member 30*p* in the welding step after end of the correction step. Therefore, preferably, in the correction step in FIG. 5(H), after the tilt of the ground electrode member 30*p* is corrected by using the jigs 410 and 420 for correction processing, the jig holding the ground electrode member 30*p* (the second jig 420 in FIG. 5(H)) is separated away from the ground electrode member 30*p* once, and the ground electrode tip 32 is placed on the tip welding surface of the ground electrode member 30*p*. The contents other than these differences are substantially the same as in FIG. 2, and thus the description thereof is omitted. The third embodiment also achieves the same advantageous effects as those in the first embodiment.

Modified Embodiments

The present invention is not limited to the above embodiments and modes and may be embodied in various other forms without departing from the scope of the invention.

Modified Embodiment 1

As a spark plug, spark plugs having various configurations other than the configuration shown in FIG. 1 can be applied to the present invention. In particular, regarding the specific shapes of the metal terminal and the insulator, various changes may be made.

Modified Embodiment 2

The direction of the metal shell 50 and the direction of the ground electrode member 30*p* in each embodiment described above are an example, and each step may be executed with directions different from those directions in each embodiment. For example, the step shown in FIG. 2(D) may be executed in a state where the axial line O of the metal shell 50 is directed in a direction parallel to the vertical direction, similarly as in FIG. 2(C). In this case as well, in the jig placing step prior to the correction step, the first jig 410 and the second jig 420 for correction processing are placed along a first direction parallel to the radial direction of the metal shell 50 and at positions away from the ground electrode member 30*p*, respectively, similarly as in the case of FIG. 2(G). In addition, the first jig 410 is placed at one side in the first direction and the second jig is placed at the other side in the first direction so as to provide a positional relation in which the ground electrode member 30*p* is sandwiched therebetween. Moreover, in the correction step, the first jig 410 is moved in a second direction opposite to the first direction to press the ground electrode member 30*p* until a state where the ground electrode member 30*p* comes into direct or indirect contact with the second jig 420, thereby decreasing the tilt angle of the ground electrode member 30*p*.

Modified Embodiment 3

Although the crimping step of assembling the insulator 10 and the center electrode 20 to the metal shell 50 is performed before the tilt step (FIG. 2(E)) in each embodiment described above, the crimping step may be performed after the welding step for the ground electrode tip 32 (FIG. 2(H)). When the insulator 10 and the center electrode 20 are assembled to the metal shell 50 before welding the ground electrode tip 32, the ground electrode tip 32 can be welded after manufacturing variations from the metal shell 50 to the center electrode 20 are grasped. Thus, dimensional variations of the spark gap of the spark plug can be reduced. Meanwhile, there is a possibility that the presence of the insulator 10 and the center electrode 20 hinders the correction step, etc. However, with the manufacturing method according to each embodiment described above, even when the insulator 10 and the center electrode 20 are present, it is possible to weld the ground electrode tip 32 with a stable shape, and the invention of the present application can achieve the advantageous effects particularly in such a situation.

Modified Embodiment 4

As the tilt processing jigs 310 and 320 or the correction processing jigs 410 and 420, jigs having various shapes and structures other than the above-described jigs may be used. In addition, although the tilt processing and the correction processing are performed by moving only the jig in each embodiment described above, the tilt processing and the correction processing may be performed by moving only the spark plug (a body obtained by joining the metal shell 50 and the ground electrode member 30*p*) or by moving both the jig and the spark plug, instead.

Modified Embodiment 5

Regarding the steps in each embodiment described above, various changes other than the above changes may be made. For example, although the screw portion 54 has not been formed in the metal shell 50 in joining the ground electrode member 30*p* to the metal shell 50, the ground electrode member 30*p* may be joined to the metal shell 50 in which the screw portion 54 has been formed, instead.

DESCRIPTION OF REFERENCE NUMERALS

10: insulator
20: center electrode
22: center electrode tip
30: ground electrode
30*p*: ground electrode member
30*pb*: bent portion
32: ground electrode tip
32*pp*: tip welding position
40: metal terminal
50: metal shell
52: front end portion
54: screw portion
100: spark plug
310: first jig (tilt processing jig)
320: second jig (tilt processing jig)
410: first jig (correction processing jig)
420: second jig (correction processing jig)

The invention claimed is:

1. A method for manufacturing a spark plug including a metal shell and a ground electrode having a ground electrode tip, the method comprising:

a joining step of joining a rod-shaped ground electrode member to a front end portion of the metal shell, next;

an assembly step of assembling an insulator and a center electrode to the metal shell, next;

a tilt step of tilting the ground electrode member in a radial direction of the metal shell, next;

a correction step of decreasing a tilt angle of the ground electrode member to an allowable tilt angle or less, next; and a welding step of welding the ground electrode tip to the ground electrode member.

2. The method for manufacturing the spark plug according to claim 1, further comprising, between the tilt step and the correction step, a jig placing step of placing a first jig and a second jig as correction processing jigs along a first direction parallel to the radial direction of the metal shell and at positions away from the ground electrode member so as to provide a positional relation in which the ground electrode member is sandwiched therebetween, the first jig being placed at one side in the first direction, the second jig being placed at another side in the first direction, wherein in the correction step, the tilt angle of the ground electrode member is decreased by moving the first jig in a second direction opposite to the first direction to press the ground electrode member until a state where the ground electrode member comes into direct or indirect contact with the second jig.

3. The method for manufacturing the spark plug according to claim 1, wherein in the tilt step, the ground electrode member is tilted outward in the radial direction of the metal shell.

4. The method for manufacturing the spark plug according to claim 2, wherein the first jig and the second jig are used as welding electrodes for resistance welding in the welding step, and in the correction step, the second jig is used in a state where the ground electrode tip is placed on an end of the second jig.

5. The method for manufacturing the spark plug according to claim 4, wherein the allowable tilt angle in the correction step is such an angle that, in the welding step, a state is obtained in which the ground electrode member and the first jig are in surface contact with each other and the ground electrode member and the ground electrode tip are in surface contact with each other.

6. The method for manufacturing the spark plug according to claim 1, wherein a position at which a tilt processing jig contacts the ground electrode member in the tilt step is different from a position at which a correction processing jig contacts the ground electrode member in the correction step.

7. The method for manufacturing the spark plug according to claim 6, wherein the correction processing jig is a jig different from the tilt processing jig.

8. The method for manufacturing the spark plug according to claim 1, wherein in the tilt step, the ground electrode member is tilted such that a bent portion is not formed at a welding position in which the ground electrode tip is welded, but is formed at a frontward position with respect to the welding position.

* * * * *